United States Patent [19]

Knauff

[11] 4,383,244

[45] May 10, 1983

[54] PSEUDO MULTI LIGHT DISPLAY DEVICE AND GENERATOR THEREFOR

[76] Inventor: Robert J. Knauff, 819 N. Gardner St., West Hollywood, Calif. 90046

[21] Appl. No.: 89,764

[22] Filed: Oct. 31, 1979

[51] Int. Cl.[3] ..... G08B 5/38; F21V 33/00

[52] U.S. Cl. ..... 340/321; 340/331; 362/78; 362/811

[58] Field of Search ..... 340/321, 331; 362/72, 362/78, 103, 192, 193, 811; 315/200 A, 205; 331/66, 113, 111, 177 R

[56] References Cited

U.S. PATENT DOCUMENTS

| | | | |
|---|---|---|---|
| 3,737,731 | 6/1973 | Zeewy | 340/331 |
| 3,789,208 | 1/1974 | Lewis | 362/78 X |
| 3,918,184 | 11/1975 | Chao | 340/331 |
| 3,965,468 | 6/1976 | Bronson | 340/331 |
| 3,986,144 | 10/1976 | Russo | 340/331 |
| 4,161,018 | 7/1979 | Briggs et al. | 362/811 |

OTHER PUBLICATIONS

"LED Indicator Draws Only 20 mw", *Electronics* (Australia), Mar. 1972, vol. 33, No. 12, p. 54, by Leo Simpson.

"LED Flasher Based On Inexpensive IC", *Electronics* (Australia), Jul. 1975, vol. 37, No. 4, pp. 52–53, by D. Edwards.

*Primary Examiner*—Donald J. Yusko

*Attorney, Agent, or Firm*—William H. Maxwell

[57] ABSTRACT

Intensified light emitting diodes intermittently energized while in motion, the light emission thereof being sensed by eyesight retention as dots and bars of light dynamically related and intermixed relative one to the other in an infinite number of geometric patterns dependent upon the simple and compound application of rectilinear, arcuate and rotary motion in combination with the frequency, spacing and duration of pulse application by a flasher circuit modified by adjustment both manually and automatically.

16 Claims, 9 Drawing Figures

PSEUDO MULTI LIGHT DISPLAY DEVICE AND GENERATOR THEREFOR

BACKGROUND

The use of instantaneously operable "strobe" lights is well known for its dazzling effects in places of entertainment and the like, characteristically systems which require considerable power and not conducive to being light weight and/or portable. High intensity strobe lights are of course battery powered for use in photography, but still far too cumbersome and much too expensive for the purposes herein disclosed. Accordingly, it is a primary object of this invention to provide a light and inexpensive instantaneous light display that is self contained and combined with motion generating means and programmed to produce pseudo multiple lighting effects.

The use of capacitor discharge light provides intense light of controlled duration, instantaneous or prolonged. Heretofore, such systems have been high voltage devices limited in use, and very expensive. On the contrary, it is an object of this invention to provide an inexpensive system of the type under consideration wherein prolonged use producing intense emission of light of controlled duration is made possible and combined with said motion generating means for the production of an infinite range of pseudo multi light effects. The geometric display of multi light patterns becomes infinite. With the present invention Light Emitting Diodes, LEDs, are employed as a low cost means for producing intense, instantaneous and/or prolonged light emission from a low voltage power source such as a small portable battery power pack.

The use of the aforesaid LEDs is met with certain problems when considering the effects sought to be attained with the present invention; the voltage applied, the frequency of application and the duration thereof, all of which are precisely controlled with the present invention. The consideration of voltage is most important because most linear integrated circuits are designed to operate with power supplies of 4.5 to 40 volts, and for this reason practically no battery portable powered equipment is ever provided with indicator lights, due to the unacceptable power drain. Furthermore, LEDs will not light from a 1.5 volt battery, and drain a sufficient battery at a rapid rate. It is an object therefore, to pulse drive the LED, utilizing what has become known in the art as a "flasher" circuit, whereby sufficient voltage for flashing an LED can be generated with a single 1.5 volt cell, and operable as low as at 1.1 volt. However, intense light is also an object herein, in which case higher voltages than 1.5 are employed, for example 6 volts applied over spaced periods of short duration. Higher threshhold voltage is required for green LEDs (yellow and orange), red emitters having a lower voltage threshold for operation.

Flashers for the aforesaid purpose are available as Integrated Circuits, ICs, which open new applications for linear circuitry. In practice sufficient voltage for flashing a light emitting diode can be generated with a cell voltage down to 1.1 volts. In such low duty cycled applications batteries will last for months to years of continuous service. Such flasher circuits become practical for marker location, emergency epuipment such as for example boat moorings to be located in the dark. Such an IC is the FLASHER LM 3909 as manufactured by National Semicunductor of Santa Clara, Calif. This IC is simple in design, easy to use, very small and light in weight, and includes internal resistors that reduce the amount of external curcuitry, and components, thus minimizing the size of a complete oscillator circuit, as will be described.

It is an object of this invention to provide adjustment for shaping the controlling pulse width spacing and duration, thereby producing a variation in lighting effect ranging from dots to bars of separated and overlapping light, when combined with said motion generating means. Electronic shaping of the pulse width space and duration modifies the LEDs appearance, from individual spots to elongated bars when combined with motion. By electronically controlling the wave form and pulse frequency and by extending the dwell time or pulse width, a series of points of light change into bars of light, and overlapping results in change of color. Accordingly, it is also an object of this invention to control the said motion generating means, whereby linear or rotational motion affects the amount of visual light points retained by the viewer. This technique is highly utilitarian and lends itself to the toy industry and like arts, where cost savings is always a prime consideration. The motion generating means is essentially linear at variable rates of speed, rectilinear or rotary motion and combinations thereof. Fundamentally, a single LED pulsed 30 times per second and moving at 30 inches per second will produce a visible light image at every inch position, or 30 points of light over a distance of 30 inches. A prolonged pulse produces a bar length commensurate with its duration. Thus, rectilinear motion produces dots and straight bars of light, advantageously employing image retension in the person's eyes viewing the phenomenon as it occurs.

It is comtemplated that the motion generating means can take various forms in addition to the directly viewed light emitters as they are disclosed as the preferred embodiment herein; for example, light projectors and viewers are contemplated and the use of mirrors and such means that provide light movement rectilinearly and rotary and compound movements thereof. In practice, the image retension provides the viewer with infinite varieties of geometric figures which are two and three dimensional and composites of the adjustably controlled light emission and motion applied, as will be described.

It is still another object of this invention to provide for automatic variation in waveform, responsive to ambient light, either to slow or to speed the circuit flash rate with an increase in ambient light. The preferred embodiment hereinafter disclosed is exemplary of the many uses to which this pseudo multi light display and generator may be put. As shown, it is an object to advantageously employ this lighting system in a roller skate wheel, or any such circular device, the roller skate providing the motion generating means by which rectilinear and rotary motion is is applied in combination with means to intermittantly illuminate lamps (LEDs). It is also an object of this invention to provide multi colored light emission, in a phase relationship that is complimentary. As shown, there are red and green LEDs carried at diametrically opposite positions upon a disc rotatable with at least one skate wheel. It will be observed therefore, that smallness and lightness are prime factors to be considered, the size and weight of the embodiment shown being applicable to roller skates without detriment to the operation thereof.

The pseudo multi light display device and generator as it is shown applied to the wheel of a roller skate is a self contained battery powered unit removeably applied to the outside face of a skate wheel and of a configuration to expose the skate hub or axle. As shown, the unit of the present invention is a ring-shaped disc with the center void for the application of tools for the servicing, removal and replacement, of the wheel and axle assembly. In carrying out this invention, the controls of the device are exposed at the front surface and periphery thereof, namely a frequency/waveform controller and an ON-OFF switch respectively.

SUMMARY OF INVENTION

The physical embodiment shown herein involves the embellishment of a skate wheel with a disc-shaped unit comprised of a housing that accommodates a variable pulse generator with accessible controls and carries visible lamps in the form of light emitting diodes. There is an adjustable frequency/waveform oscillator circuit which modifies the function of an integrated flasher circuit carried on a circuit board which relates electronic elements therewith for the determined control over the pulse width spacing and duration as required. An electric energy power supply in the form of a battery of cells is also carried by the circuit board, all within the confines of the housing. There is at least one visible LED and preferably a pair of diametrically opposite LEDs circumferentially spaced and of distinguishable color such as red and green. For automatic adjustment of the frequency/pulse waveform in response to ambient light, there is a photo sensitive means carried by the circuit board and disposed through the housing to sense the surrounding light to either increase or decrease the flash rate, as desired. Installation upon the skate wheel is by means of adhesive, preferably a double faced foamed plastic body which conforms to irregularities at the interfaces between the skate wheel and unit housing.

The foregoing and other various objects and features of this invention will be apparent and fully understood from the following detailed description of typical preferred forms and applications thereof, throughout which description reference is made to the accompanying drawings.

Figure 6:
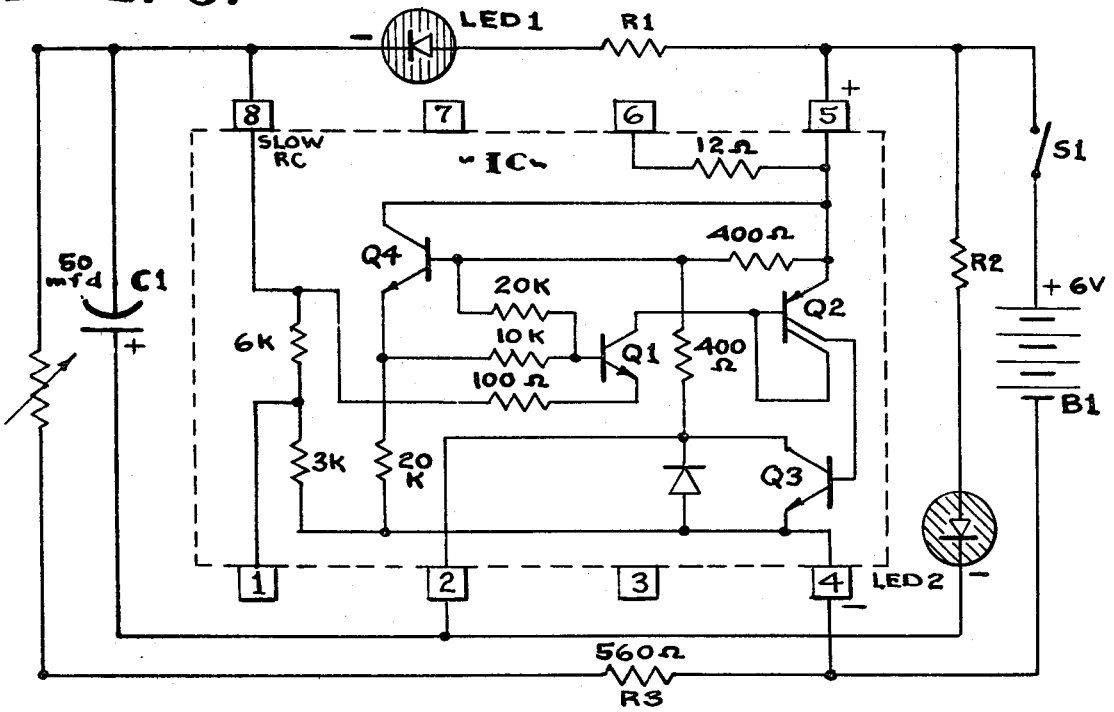
FIG. 6 is a schematic of the present inventive combination with the flasher circuit of FIG. 5 as it is embodied in an integrated circuit.
Figure 8:
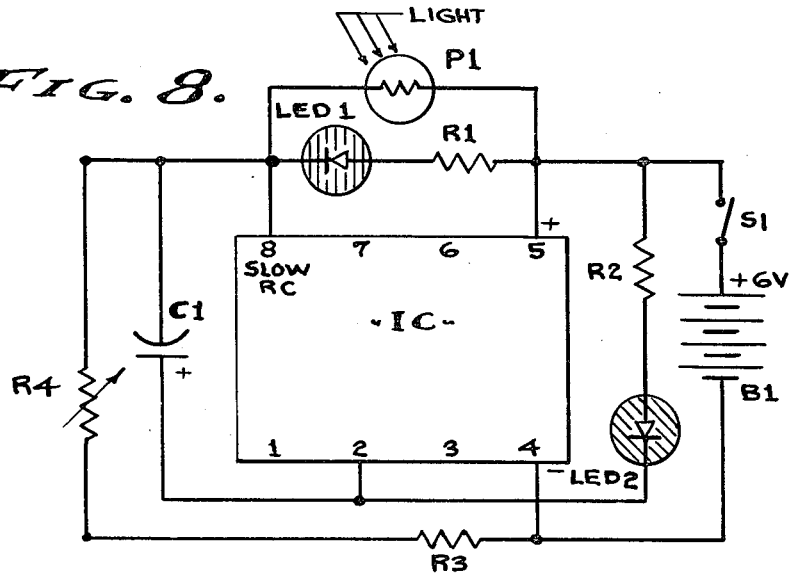
Figure 9:
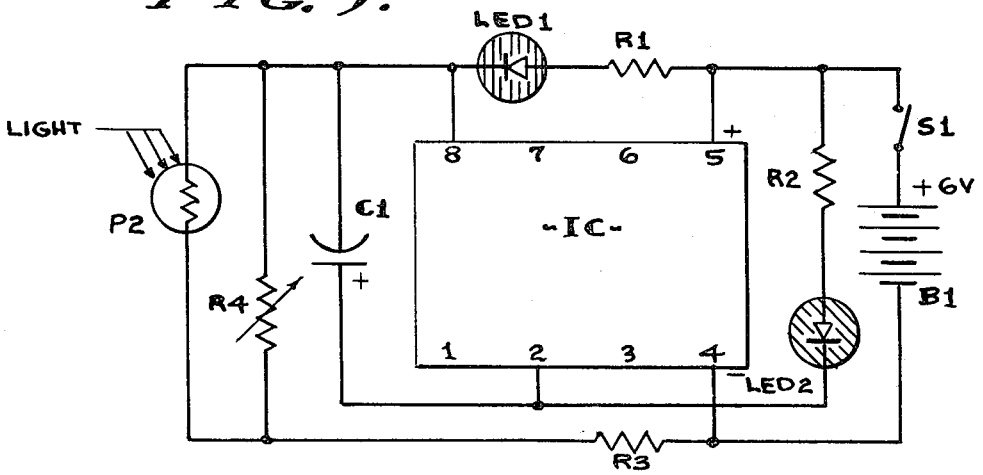

And, FIGS. 8 and 9 are schematic views similar to FIG. 6, FIG. 8 showing the integrated circuit subjected to frequency control by means of a photo sensor that responds to ambient light, and FIG. 9 showing frequency control through the combined circuitry by means of a photo sensor in the timing resistance circuit therefor.

PREFERRED EMBODIMENT

A wide variety of three dimensional effects and geometrical patterns are achieved by rotating intermittently emitting light sources while simultaneously moving the same in one or two directions and coordinates as is the case with the Roller Skate Visual Disc herein disclosed as the preferred form of the invention. For example, the disc herein disclosed is attached to one of the outside wheels of a skate, with two pulsating LEDs exposed at diametrically opposite positions thereon and spinning with rotation of the wheel. Assuming that the skater is moving forwardly in one direction a linear motion component is produced, and the spinning disc produces a rotary component that displays pseudo multi light points dependant upon speed and direction of the motions and pulse frequencies of light emission. A side thrust of the skate creates a three dimensional component that displays a spiral image, the combination of the forward motion component and the side motion component, forming a third or diagonal component.

Referring now to the drawings, a left roller skate is shown with its usual four wheeled configuration comprised of front and rear axles 10 carried by angularly pivoted trucks 11 and upon each of which a pair of roller wheels 12 rotate freely on antifriction bearings (not shown). The wheels 12 are right cylinders having a rolling periphery and normal side faces, the outer face 13 to which the display device is held by securement means 16. The outer side configurations of wheels 12 vary widely, and generally it can be said that the center is a recess 14 to accommodate the axle retainment means or nut 15. Recess 14 is the feature which varies in form from a simple counterbore to a stepped and sometimes conical counterbore. However, the outer peripheral portion of the side face 13 is substantially flat and disposed in a plane normal to the rotational axis. Accordingly, the securement means 16 is a double sided foamed plastic adhesive pad that conforms to any irregularities, using a pressure sensitive adhesive that bonds to the interfaces of the wheel 12 and unit housing H next to be described.

The pseudo multi light display device and generator therefor is accommodated entirely within the housing H, in the embodiment shown as a disc-shaped shell in which the components of the device are securely mounted and through which the controls are accessible and light emitting and sensing means visible and exposed respectively. The principal components are an integrated circuit IC, and at least one and preferably two light emitting diodes LED1 and LED2, the former being an emitter of red light having a low voltage threshold, and the latter being an emitter of green light having a higher voltage threshold. Also included as a principal component is a capacitor C1 and the power supply B1 comprised of a battery of 1.5 volt cells, preferably silver oxide cells of wafer-shape, or flattened cylinder form. These principal components are carried with the modifying components later described, upon a circuit board B enclosed within the housing H of divided shell form comprised of a base 20 and a cover 21 secured one to the other forming a chamber therebetween. A feature is the central opening 22 through the housing H, of such diameter to pass a normal socket wrench W for replacing the nut 15. Accordingly, the housing H is characterized by inner and outer diameter wall 23 and 24 concentric with axle 10 and extending between inner and outer side walls 25 and 26, thereby establishing an annular chamber for the accommodation of the aforesaid principal components and others as will be described.

The motion generating means is provided in the roller skate as shown and described, and which involves the freely rotatable wheel 12 onto which the housing H is concentrically attached by the securement means 16. This motion generating means or moveable wheel 12 spins at varying speeds dependent upon the skater's activity, whereby the LEDs orbit about the center axis of rotation to provide the circular motion component. Forward, or rearward, rolling movement of the skate provides a first rectilinear motion component. And, the side to side and up and down movements of the skate provide second and third rectilinear motion components. Simultaneous application of said rectilinear components provides arcuate motion. Increased rotary motion establishes the optical illusion of arcuate bars of light commensurate in length and shape according to time, speed of and direction of motion; and there can be an overlap of red and green light retained by the viewers retina, in which case there is a color change to amber (also refer to pulse space and duration).

The circuit board B provides the electrical circuitry and carries the electronic components within the chamber of housing H, and is the centering element for the housing base and cover 20 and 21. Characteristically, the board B is a flat sheet of dielectric material disposed in the plane of joinder between base 20 and cover 21, and extending radially between the inner and outer diameter walls 23 and 24. The opposed edges of the outer diameter walls 24 are concentrically stepped to receive the outer diameter of the board, thereby centering all three parts relative to each other. As shown, the board B is a sectional ring, having a power supply section 30 and a printed circuit section 31. The power supply section 30 is punched out with openings that receive the battery cells, while the printed circuit section 31 is provided with the necessary conductors comprised of remaining clad after etching, as is customary with printed circuits. A feature is the punched out opening that receives the capacitor C1, and all to the end that the thickness of the circuit board assembly is no greater than the cross sectional dimension of the capacitor C1 or the battery cells B1 (nominally 8 mm). The principal components are soldered to the circuit board conductors through their leads or stand-off conductors, and interconnected by jumpers as is indicated and according to the schematic as shown.

Figure 5:
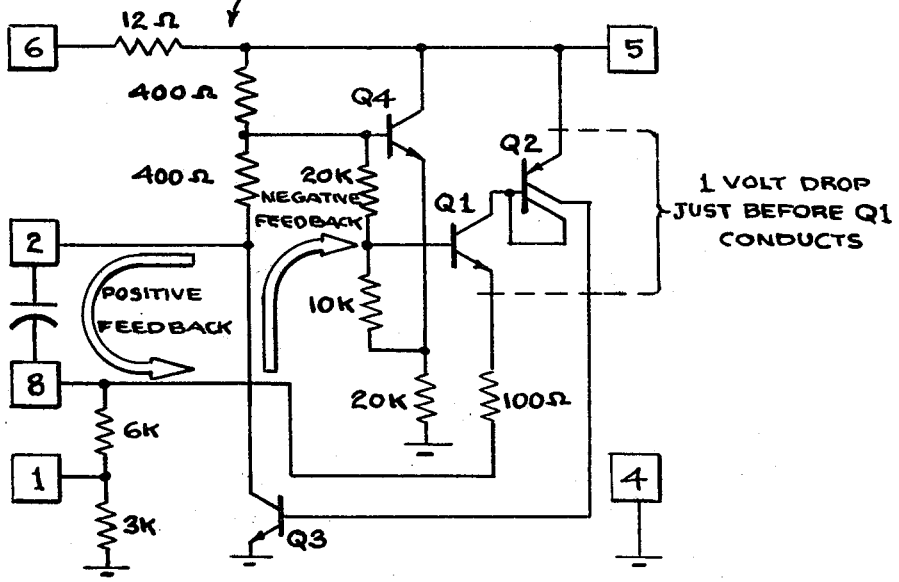
FIG. 5 is a simplified schematic of the flasher circuit characterized by its positive and negative feedback function.
Figure 7:
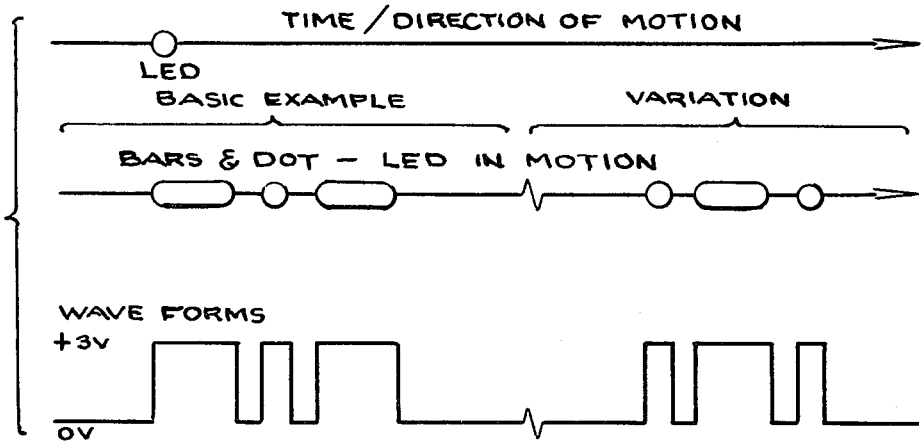
FIG. 7 is a diagram of typical wave forms and the visual product of light as related to time and motion, in the form of dots and bars.

Referring now to the simplified flasher circuit IC schematic as it is diagramed in FIG. 5 of the drawings, the basic oscillator circuit is shown to operate on 1.5 volts applied to pin 5. Current flows through the 3k and 6k timing resistors and through the emitter of Q1. This current is amplified about threefold by transistor amplifier Q2 and passed to the base of power transistor Q3. Transistor Q3 then conducts, pulling down on the bases of feedback transistors Q1 and Q4. This is a negative feedback that reduces timing resistor current at the base of power transistor Q3 until a balance is reached. This occurs with the collector of transistor at about 0.5 volts, with the base of transistor Q4 at about 1 volt, and with a very small voltage from pin 8 to ground. The difference between these two voltages at Q3 and Q4 is the base emitter drop at Q1 and two thirds of the base emitter drop at Q4 as set by the high resistance divider from its base to emitter. The feedback voltage is attenuated by the value of at least two by means of the divider comprised of two 400 ohm resistors as shown. The positive capacitor feedback is at initial unity, and therefore the DC bias condition and the temporary excess positive feedback conditions are met and the circuit must oscillate. The wave form at pin 8 of this basic oscillator circuit is shown in FIG. 7 of the drawings. The waveform at pin 2, the power transistor collector, is substantially rectangular, as it extends from a saturation voltage of 0.1 volt or less to within about 0.1 volt of the supply voltage. The "ON" period of course coincides with the negative pulses at pin 8. Other circuit voltages can be inferred from the aforesaid two waveforms.

Referring now to the intensified and controlled waveform generator and pseudo multi light display device of the present invention as it is diagramed in FIG. 6 of the drawings, the power supply is a battery of four 1.5 volt cells arranged in series to produce 6 volts and thereby increase and intensify the light output of the LEDs and to meet the higher threshold voltages required of certain LEDs including green, yellow and orange LEDs. As shown, a green LED2 is connected between the positive potential of the 6 volt power supply and the power transistor Q3 (IC pin 2). The LED current limiting resistance values are increased by resistors R1 and R2 in order to keep current peaks within the IC and LED limits as specified by the manufacturer. The resistance values of resistors R1 and R2 are chosen for the best visual balance of LED1 and LED2 operating within said specified limits.

An "ON-OFF" switch is provided in the assembly of the housing H and circuit board B. The base 20 and cover 21 of the housing are circumferentially notched to shiftably accommodate a conductive slide 35 that embraces the circuit board to move thereon into and out of dual contact with spaced printed circuit conductors on the board. The slide 35 is a resilient metalic member that opens and closes the positive side of the power supply circuit, the slide having a projection exposed for manual engagement.

The waveform generator of the present invention adjustably controls the frequency and shape of the pulse amplitude and width, as well as the spacing thereof, in the form of maximum electrical energy to drive the LEDs. It is pulse amplitude, spacing and width, and voltage that are controlled; (1) Pulse amplitude being a function of pulse voltage times pulse width, or $PV \times PW = PA$. The pulse amplitude when the drive output is at logic 1 as in the ON state must not be greater than the electrical characteristics of an applied infrared light emitting diode, a light emitting diode, or high speed light, for proper lamp life, (2) pulse space being the duration of time when the drive output is at 0 logic or in the OFF state. For example 100 micro sec. to 1,000 milli-sec. in duration. (3) pulse width being the duration of time a pulse at full PV or in the ON state. For example and typically, 10 micro sec. to 100 milli-sec. in duration. Note that bars are created from dots when the LEDs are in motion commensurate in length with the pulse. (4) and, pulse voltage being the peak voltage potential of said waveform.

Figure 1:
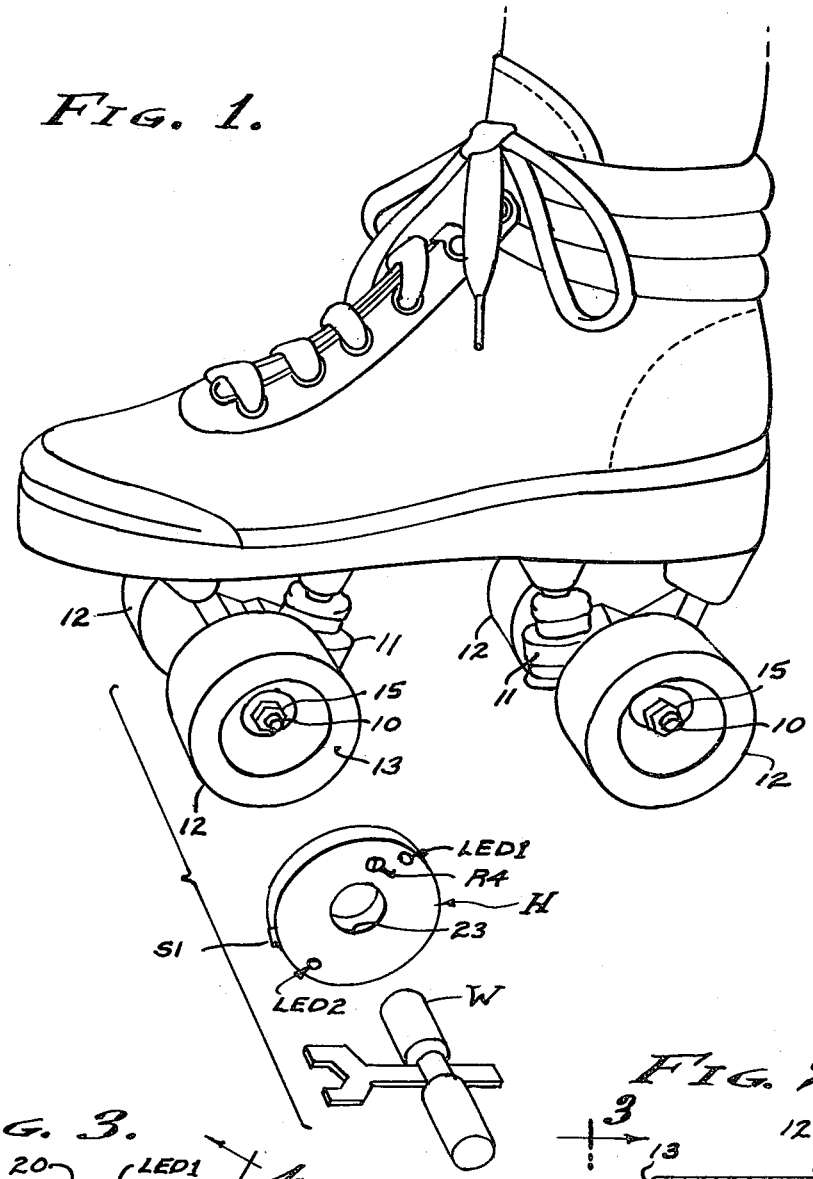
FIG. 1 is an exploded view showing the application of the present invention to a roller skate wheel.
Figure 3:
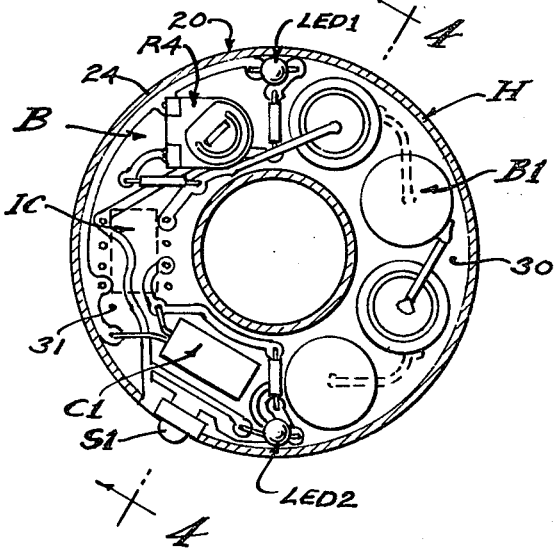
FIG. 3 is a sectional view taken as indicated by line 3—3 on FIG. 2 and showing the physical embodiment of electronic components in a preferred arrangement within the confines of a disc-shaped housing therefor.
Figure 2:
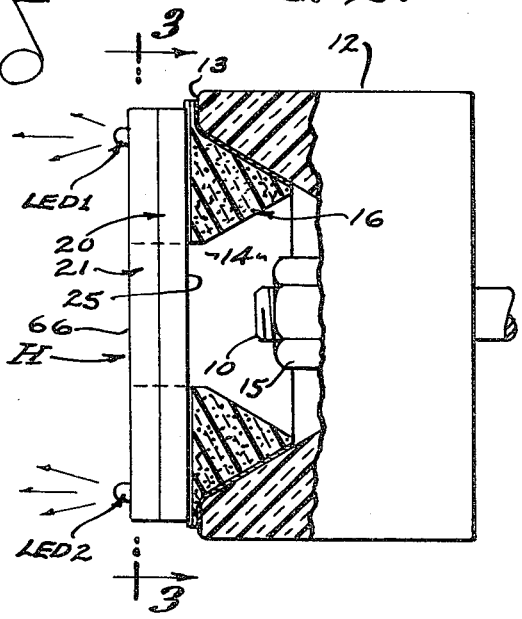
FIG. 2 is an enlarged sectional view of of roller skate wheel with the DISPLAY DEVICE applied thereto.
Figure 4:
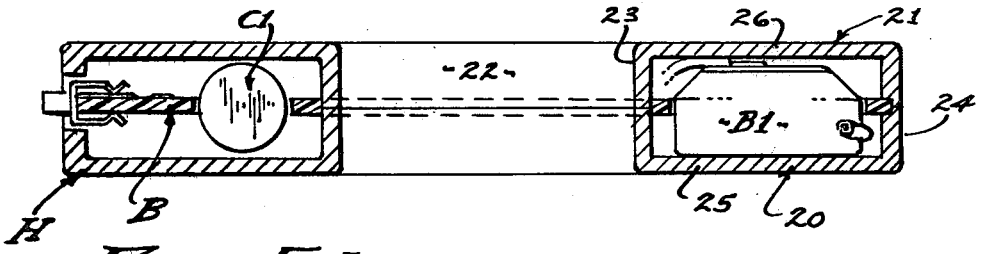
FIG. 4 is an enlarged detailed sectional view taken as indicated by line 4—4 on FIG. 3.

The waveform generator is a variable frequency generator adjusted by a variable control resistor R4 in series with a limiting resistor R3. As shown in FIG. 1 the control element of resistor R4 is accessible through an opening in the outside wall 26 of the housing H. The control timing bias of the B1 potential is derived through the limiting resistor R3 and adjusted by resistor R4. The timing capacitor C1 is connected between the negative sides of LED1 and LED2, and the adjustably controlled bias is from the negative side of the B1 power supply to the negative side of LED1, a red light emitter. The value of timing capacitor C1 is approximately 50 mfd. which facilitates intense lighting of LED1 at higher switching frequencies. By adjusting control resistor R4, the waveform generator is made to oscillate at different rates, and this adjustment greatly increases visual effect when combined with the aforementioned rotary and compound rectilinear motion.

The LED1 and LED2 are exposed through the peripheral portion of housing H at diametrically opposite positions where they are simultaneously pulsed according to the adjusted pulse amplitude, spacing, width and voltage. When control resistor R4 is set at its minimum to normal resistance, the red LED1 goes ON and OFF with the green LED2. However, when control resistor F4 is set at its maximum resistance and B1 is at full potential, red LED1 remains partially on, which allows for an interesting visual effect in the form of a soft red ring of light punctuated by bursts of intense red light. Another interesting visual effect is due to the fact that LED1 is connected in series with the timing capacitor C1 so that its output is a function of capacitor C1 and the timing network setting, whereas LED2 is connected directly to the power transistor Q3 output of the IC that puts the LED2 in the "ON" state out of synchronism with the LED1 "ON" state and which produces visual light bursts that overlap at different segments of revolvement.

Automatic adjustment of the control over frequency is achieved in one of the two ways. As shown in FIG. 8 of the drawings a photo sensitive device P1 is connected between positive pin 5 and "slow RC" pin of the IC, for example a photocell with a resistance span of 1 meg ohm dark/100 ohm light photocell, so as to slow the circuit frequency with an increase of ambient light to which the cell is exposed through an opening in the housing H. As shown in FIG. 9 of the drawings a photo sensitive device P2 is connected (with or without variable resistor R4) intermediate the timing resistors R3 and R4 and to the negative side of LED1, for example a photocell with a resistance span of 500K ohm dark/100 ohm light, so as to speed the circuit frequency with an increase of ambient light to which the cell is exposed through an opening in the housing H.

From the foregoing it will be seen that I have provided a self contained device wherein a battery powered frequency/pulse wave form generator intensely illuminates light emitting diodes intermittently while in motion, for various purposes among which are the following: Model kits and toys to simulate blinker lights and beacons; Science fiction vehicles to simulate rocket motors and ray guns, and orbiting ring effects as with space vehicles; Scientific time/speed measurement where finite calibration is related to linear or angular displacement of the LED or LEDs herein disclosed; Theatrical props to be used by dancers and various performers for creating effects and interpretations as they may be combined with artistry and in gymnastics and dancing or in athletics such as swimming, running and vaulting etc; As related to displays and for example in pinball machines and such amusement devices; And in addition to the roller skates herein disclosed, for purposes of display associated with musical instruments of rock groups, frisbees, novelties and badges, yoyos, gun sights and targets, secondary lamp lighting, ice skates and skate boards. Accordingly, there is a wide variety of uses to which such ornamental displays and more serious scientific applications may be employed, all according to the disclosure herein.

Having described only the typical preferred forms and applications of my invention, I do not wish to be limited or restricted to the specific details herein set forth, but wish to reserve to myself any modifications or variations that may appear to those skilled in the art as set forth within the limits of the following claims.

I claim:

1. A dynamic display device for intensified illumination with a light emitting diode when in motion, and including in combination;
   - a battery power supply comprised of at least one cell producing a voltage,
   - a flasher circuit means for intermittent oscillator capacitance discharge of and producing a spaced pulse/waveform at maximum light emitting diode operating voltage and extended duration,
   - a light emitting diode connected between the positive potential of the power supply voltage and a power transistor of said flasher circuit means,
   - a timing capacitor connected between the negative side of the light emitting diode and said power transistor of said flasher circuit means,
   - and a bias connected between the negative side of said light emitting diode and the negative potential of the power supply voltage,
   - whereby the spaced pulse operation of the flasher circuit means intensely illuminates the light emitting diode in motion at a determined frequency to be sensed by eyesight retention as dots and bars of light.

2. The dynamic display device as set forth in claim 1, wherein the flasher circuit means comprises a resistance responsive time controlled means to change the pulse frequency thereof, and wherein a light responsive and voltage varying means is connected between a positive voltage and said resistance responsive time controlled means to vary its frequency of operation.

3. The dynamic display device as set forth in claim 1, wherein a light responsive and voltage varying means is connected in parallel with said bias between the negative side of the power supply voltage and the negative side of said light emitting diode.

4. The dynamic display device as set forth in claim 1, wherein the bias between the power supply and said diode is a light responsive and voltage varying means operable to change pulse frequency.

5. A dynamic display device for intensified illumination with a light emitting diode when in motion, and including in combination;
   - a battery power supply comprised of at least one cell producing a voltage,
   - a flasher circuit means for intermittent oscillator capacitance discharge of and producing a spaced pulse/waveform at maximum light emitting diode operating voltage and extended duration, and including circuit means comprising a time controlled transistor with its emitter output amplified and passed to the base of a power transistor which conducts and pulls down on the base of said time controlled and a feedback transistor, a light emitting diode connected between the positive potential of the power supply voltage and a power transistor of said flasher circuit means, a timing capacitor connected between the negative side of the light emitting diode and said power transistor of said flasher circuit means, a bias connected between the negative side of said light emitting diode and the negative potential of the power supply voltage, and divider means attenuating a negative feedback voltage between said power transistor, there being a positive feedback capacitor at an initial unity between the base of the feedback transistor and the emitter of said time controlled transistor, producing the spaced pulse amplitude equal to pulse voltage times pulse width and intensely illuminating the light emitting diode in motion at a determined frequency to be sensed by eyesight retention as dots and bars of light.

6. The dynamic display device as set forth in claim 5, wherein the light emitting diode has a resistor in series therewith to keep current peaks within operational limits thereof.

7. A dynamic display device for intensified illumination with light emitting diodes when in motion, and including in combination;

a battery power supply comprised of at least one cell producing a voltage, a flasher circuit means for intermittent oscillator capacitance discharge of and producing a spaced pulse/waveform at maximum light emitting diode operating voltage and extended duration, a pair of light emitting diodes of distinct basic color and of different operational threshold values connected between the positive potential of the power supply voltage and a power transistor of said flasher circuit means, a timing capacitor connected between the negative sides of the light emitting diodes, and a bias connected between the negative side of the power supply voltage and the negative side of one of said light emitting diodes, whereby the spaced pulse operation of the flasher circuit means intensely illuminates the light emitting diodes in motion at a determined frequency to be sensed by eyesight retention as dots and bars of light.

8. The dynamic display device as set forth in claim 7, wherein the battery power supply is comprised of a series of cells with a combined voltage output to meet the operational threshold voltage of the light emitting diodes.

9. The dynamic display device as set forth in claim 7, wherein the battery power supply is comprised of a series of four 1.5 volt cells with a combined 6 volt output to meet the operational threshold voltage of the light emitting diodes.

10. The dynamic display device as set forth in claim 7, wherein the flasher circuit means comprises a time controlled transistor with its emitting output amplified and passed to the base of a power transistor which conducts and pulls down on the base of said time controlled and a feedback transistor, a divider means attenuating a negative feedback voltage between said power transistor and said feedback transistor, there being a positive feedback capacitor at an initial unity between the base of the feedback transistor and the emitter of said time controlled transistor, producing a pulse amplitude equal to pulse voltage times pulse width.

11. The dynamic display device as set forth in claim 10, wherein the negative side of the power transistor is connected between the negative sides of the light emitting diodes.

12. The dynamic display device as set forth in claim 10, wherein the pair of light emitting diodes are of distinct higher and lower operational threshold voltage, and wherein the negative side of the power transistor is connected between the negative sides of the light emitting diodes.

13. The dynamic display device as set forth in claim 10, wherein the battery power supply is comprised of a series of cells with a combined voltage output to meet the operational threshold voltage of the light emitting diodes, wherein the pair of light emitting diodes are of distinct higher and lower operational threshold voltage, and wherein the negative side of the power transistor is connected between the negative sides of the light emitting diodes.

14. The dynamic display device as set forth in claim 7, wherein the flasher circuit means comprises a resistance responsive time controlled means to change the pulse frequency thereof, and wherein a light responsive and voltage varying means is connected between a positive voltage and said resistance responsive time controlled means to vary its frequency of operation.

15. The dynamic display device as set forth in claim 7, wherein a light responsive and voltage varying means is connected in parallel with said bias between the negative side of the power supply voltage and the negative side of said one light emitting diode.

16. The display device as set forth in claim 7, wherein the bias between the power supply and one of said diodes is a light responsive and voltage varying means operable to change pulse frequency.

* * * * *